US011759010B2

(12) United States Patent
Drew et al.

(10) Patent No.: US 11,759,010 B2
(45) Date of Patent: Sep. 19, 2023

(54) SUPPORTIVE AND AESTHETICALLY PLEASING ADJUSTABLE SHELF SYSTEM

(71) Applicant: Delta Cycle Corporation, Randolph, MA (US)

(72) Inventors: Errol Drew, Los Gatos, CA (US); Glenn Lars Hansen, San Jose, CA (US)

(73) Assignee: Delta Cycle Corporation, Randolph, MA (US)

( * ) Notice: Subject to any disclaimer, the term of this patent is extended or adjusted under 35 U.S.C. 154(b) by 0 days.

(21) Appl. No.: 17/978,547

(22) Filed: Nov. 1, 2022

(65) Prior Publication Data

US 2023/0240442 A1 Aug. 3, 2023

Related U.S. Application Data

(60) Provisional application No. 63/304,204, filed on Jan. 28, 2022.

(51) Int. Cl.
*A47B 57/42* (2006.01)
*A47B 96/14* (2006.01)

(52) U.S. Cl.
CPC ..... *A47B 57/42* (2013.01); *A47B 96/1458* (2013.01); *A47B 96/1475* (2013.01)

(58) Field of Classification Search
CPC . A47B 57/42; A47B 96/1458; A47B 96/1475; A47B 57/06; A47B 57/08; A47B 57/10; A47B 57/16; A47B 57/30; A47B 57/32; A47B 57/34; A47B 57/40; A47B 57/402; A47B 96/027; A47B 96/06; A47B 96/061
See application file for complete search history.

(56) References Cited

U.S. PATENT DOCUMENTS 3,234,897 A * 2/1966 Berk ..... A47B 57/42 108/147.11
3,983,823 A * 10/1976 McDonnell ..... A47F 5/10 108/147.11
5,004,198 A * 4/1991 Jager ..... A47F 5/106 248/224.8
D323,452 S * 1/1992 Stumpf ..... D8/381
5,253,835 A * 10/1993 Herron, III ..... A47B 96/1408 211/187
D345,499 S * 3/1994 Padilla ..... D8/381
5,313,891 A * 5/1994 Suttles ..... A47B 47/022 211/186
5,348,385 A * 9/1994 Berg ..... A47B 57/04 211/187
6,644,609 B1 * 11/2003 Scott ..... A47B 96/1458 248/909
6,663,201 B2 * 12/2003 Herron, III ..... A47B 96/028 312/245

(Continued)

*Primary Examiner* — Devin K Barnett
(74) *Attorney, Agent, or Firm* — Iandiorio Teska & Coleman LLP

(57) ABSTRACT

An adjustable shelf system includes a vertical support member with slots therein, brackets each having at least one rearward hook engageable into a said slot, a shroud behind and about opposing sides of the vertical support member, and a cover member separable into strips configured for placement over the front face of the vertical support member and mateable with the shroud above and below the brackets.

5 Claims, 10 Drawing Sheets

(56) References Cited

U.S. PATENT DOCUMENTS

| | | | | |
|---|---|---|---|---|
| 7,478,785 | B2 * | 1/2009 | Herron, III | A47B 96/061 248/221.11 |
| 8,365,928 | B1 * | 2/2013 | Lauro | A47B 57/34 211/183 |
| 10,610,016 | B2 * | 4/2020 | Nilsson | A47B 57/16 |
| 11,224,289 | B1 * | 1/2022 | Hutson | A47B 96/1408 |

* cited by examiner

SUPPORTIVE AND AESTHETICALLY PLEASING ADJUSTABLE SHELF SYSTEM

RELATED APPLICATIONS

This application claims benefit of and priority to U.S. Provisional Application Ser. No. 63/304,204 filed Jan. 28, 2022, under 35 U.S.C. §§ 119, 120, 363, 365, and 37 C.F.R. § 1.55 and § 1.78, which is incorporated herein by this reference.

FIELD OF THE INVENTION

This invention relates to an adjustable shelf system and coverings therefore.

BACKGROUND OF THE INVENTION

Adjustable shelves typically include a pair of vertical support members with slots therein and brackets having rearward hooks engageable into the slots of the vertical support members. Then, a shelf is placed on the brackets. See, for example, U.S. Pat. Nos. 3,729,161; 4,070,803; and 2008/0272076 all incorporated herein by this reference. Such shelving systems are often used in garages, basements, dorm rooms, and the like but are not usually thought suitable for offices, living rooms, apartments, or the like because of their utilitarian appearance.

In response, efforts have been made to provide more aesthetically pleasing front covers over the vertical support members. See, for example, U.S. Pat. Nos. 6,664,609; 4,966,343; 7,967,268; and Des. 345,499 all incorporated herein by this reference.

SUMMARY OF THE INVENTION

One problem with such front covers is how to cover the vertical supports without interfering with the brackets which extend outward from the vertical supports. For example, the covers of U.S. Pat. No. 6,644,609 include an aperture which opens to the top edge of the cover and which is sized to accept a bracket therethrough. Multiple covers are thus adhered to the vertical supports and careful measurements must be taken in order to install the covers.

Provided is a new adjustable shelf covering system which is easy to install, which is inexpensive, and which is assembled quickly. Also provided is a covering system which supports the vertical support members resulting in an adjustable shelf system which is stronger.

The subject invention, however, in other embodiments, need not achieve all these objectives and the claims hereof should not be limited to structures or methods capable of achieving these objectives.

Featured is an adjustable shelf system comprising a vertical support member with slots therein and brackets each having at least one rearward hook engageable into a said slot. A shroud can be fitted behind and about opposing sides of the vertical support member and a cover member is separable into strips and is configured for placement over the front face of the vertical support member and mateable with the shroud above and below the brackets.

The cover member is preferably cuttable into said strips. The shroud is preferably in the form of a channel member. In one version, the shroud includes spaced support ribs abutting and supporting the vertical support member.

Also featured is an adjustable shelf system comprising a C-shaped vertical support member with slots in a front face thereof and sidewalls which mount to a wall and a bracket having at least one rearward hook engageable into a said slot. A C-shaped shroud can be fitted behind the vertical support member and includes sidewalls for covering the sidewalls of the C-shaped vertical support member, a rear wall with ribs for abutting and supporting the vertical support member, and a channel for the vertical support member between the shroud side walls. A cover member is separable into strips configured for placement over the front face of the vertical support member and mateable with the shroud above and below the brackets.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
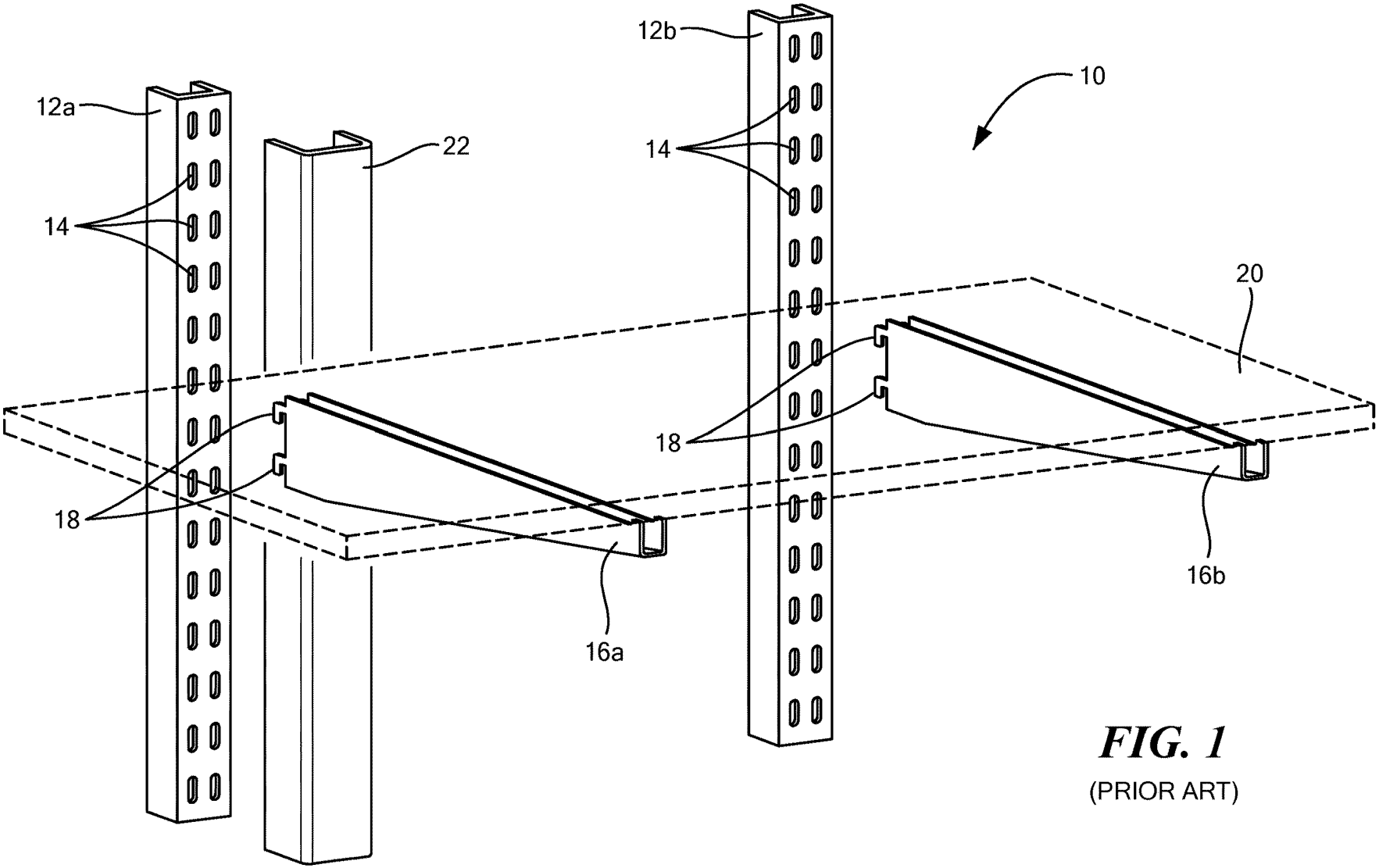
FIG. 1 (PRIOR ART)
FIG. 1 is a schematic view showing an example of a prior art shelving system with a cover for each upright support member.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

FIG. 1 shows prior art adjustable shelf system 10 with two spaced vertical support members 12*a*, 12*b* each with one or more rows of slots 14. Brackets 16*a*, 16*b* include hooks 18 received in a chosen set of slots and shelf 20 resides on bracket 16*a*, 16*b*. As noted above, a front cover 22 may be provided for each support member 12*a*, 12*b* in order to cover the slots, mounting hardware, and the like. But, means must be included to accommodate the bracket 16*a*, 16*b*.

Figure 2A:
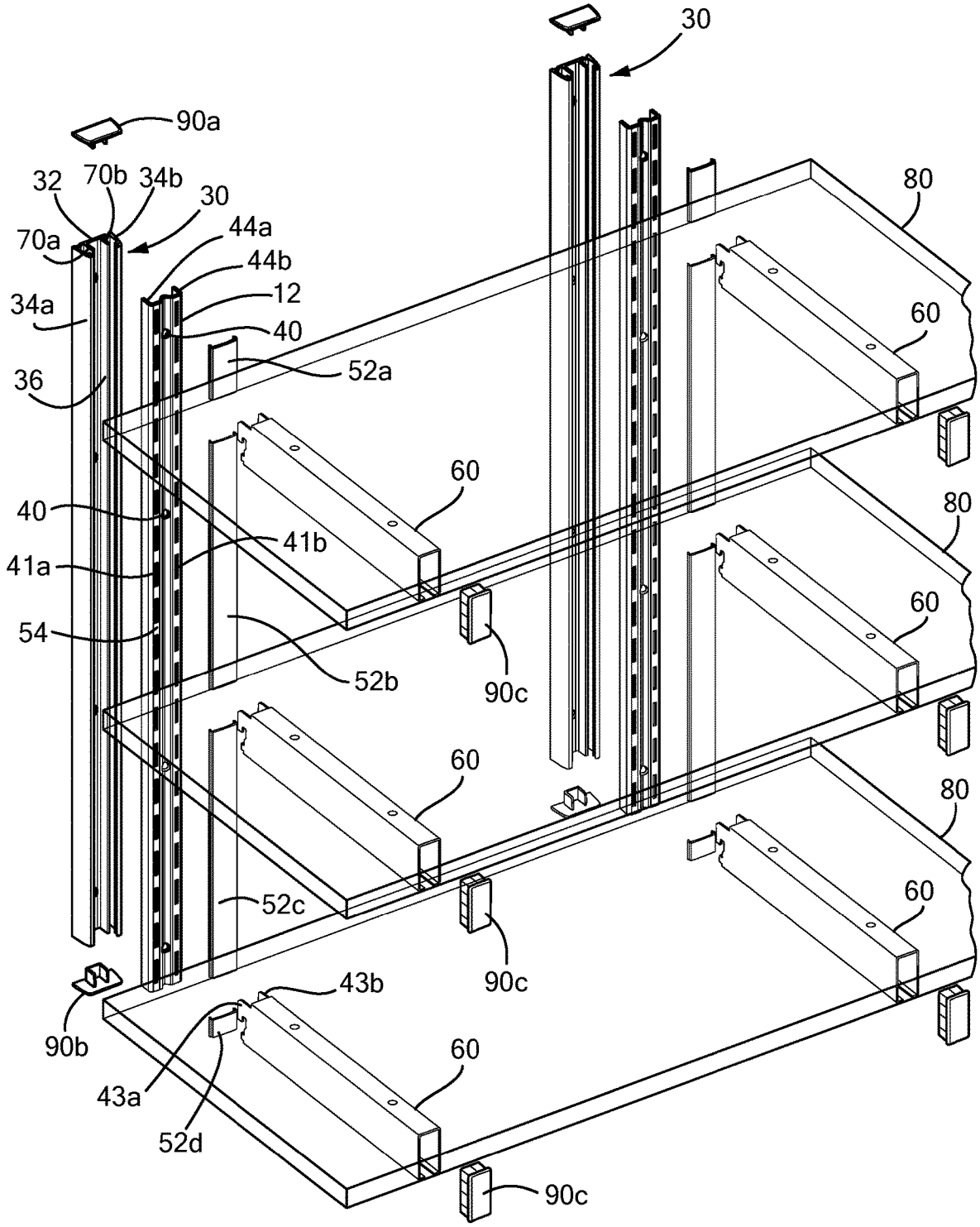
FIGS. 2A-2B are exploded views showing an example of the new supportive and aesthetically pleasing adjustable shelf system.
Figure 2B:
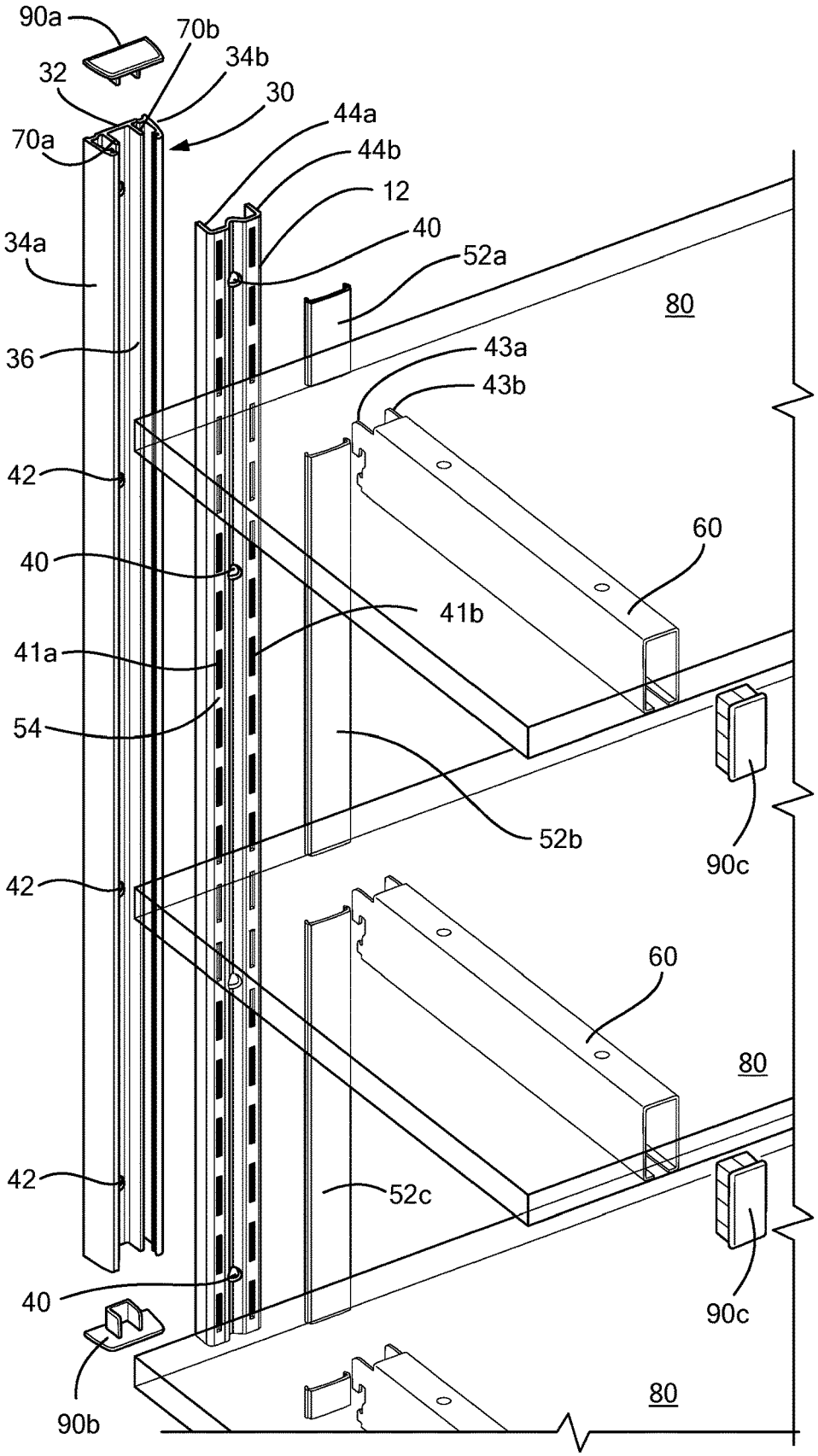
Figure 6:
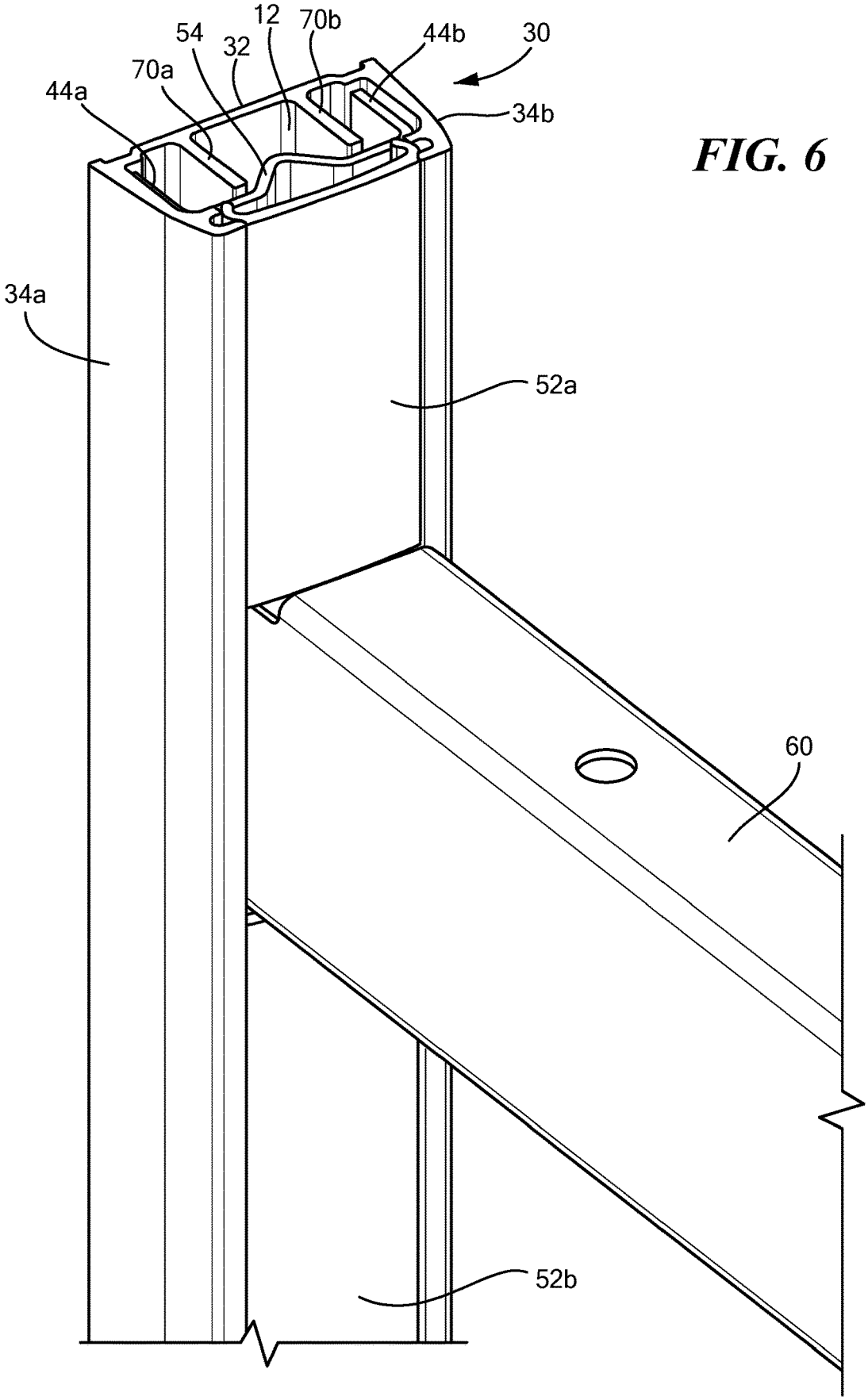
FIG. 6 shows again a preferred shelf system.

Featured here, in one design, is shroud 30, FIGS. 2A-2B are preferably in the form of a channel member with rear wall 32 between sidewalls 34*a*, 34*b* defining channel 36 therebetween accepting vertical support member 12 therein. Fasteners, for example, extend through holes 40 in vertical support member 12, through holes 42 in shroud 30 rear wall 32, and into the wall for mounting both the shroud 30 and the vertical support member 12 in unison. The vertical support member is urged into the shroud channel as the screws are tightened. See FIGS. 6-7. Shroud 30 is then located behind vertical support member 12 and the walls 34*a* and 34*b* abut and cover the opposing sides 44*a*, 44*b* of the vertical support member 12. Another similar vertical support member is also installed with its own shroud.

Then, the brackets 60 are installed into the vertical support members. In the design shown, vertical support member 12 includes a series of spaced slots 41*a*, 41*b* and each bracket 60 includes spaced rearward hooks 43*a*, 43*b* received in a desired set of slots 41*a*, 41*b*. Next, a cover member is separated (e.g., cut) into strips 52*a*, 52*b*, 52*c*, and 52*d* and the like and placed over the front face 54 of vertical support member 12 and mated with the shroud 30 above and below each bracket. In one example, the plastic strips 52 snap fit into the plastic shroud channel. Cover strips are also similarly placed over the other vertical support member. Then, shelves 80 are placed on the brackets as shown.

In this way, the rear, front, and sides of the vertical support members are covered. Shroud 30 and the front covers also provide additional support and strength for the adjustable shelf. When the vertical support members are configured as a C-channel shape as shown, it is rearward facing relative to the wall it is mounted to and the shroud is a forward facing C-channel shape relative to the wall it is also mounted to. Preferably, sidewalls 34*a*, 34*b* of shroud 30 extends slightly outward of the extent of vertical support member 12 in order to accommodate the cover strips between the sidewalls of the shroud. Also, preferably, the width of the shroud channel 36 between the sidewalls 34*a*, 34*b* matches approximately the width of vertical support member 12. In a preferred design, spaced ribs 70*a*, 70*b* extend outwards from shroud rear wall 32 and abut and support vertical member 12. In this way, especially when a bracket 60 is located between the screws driven through the shroud and vertical support member and experiences a downward force, the ribs prevent vertical support member 12 from bending especially in the area between adjacent fasteners driven into the wall.

Figure 5A:
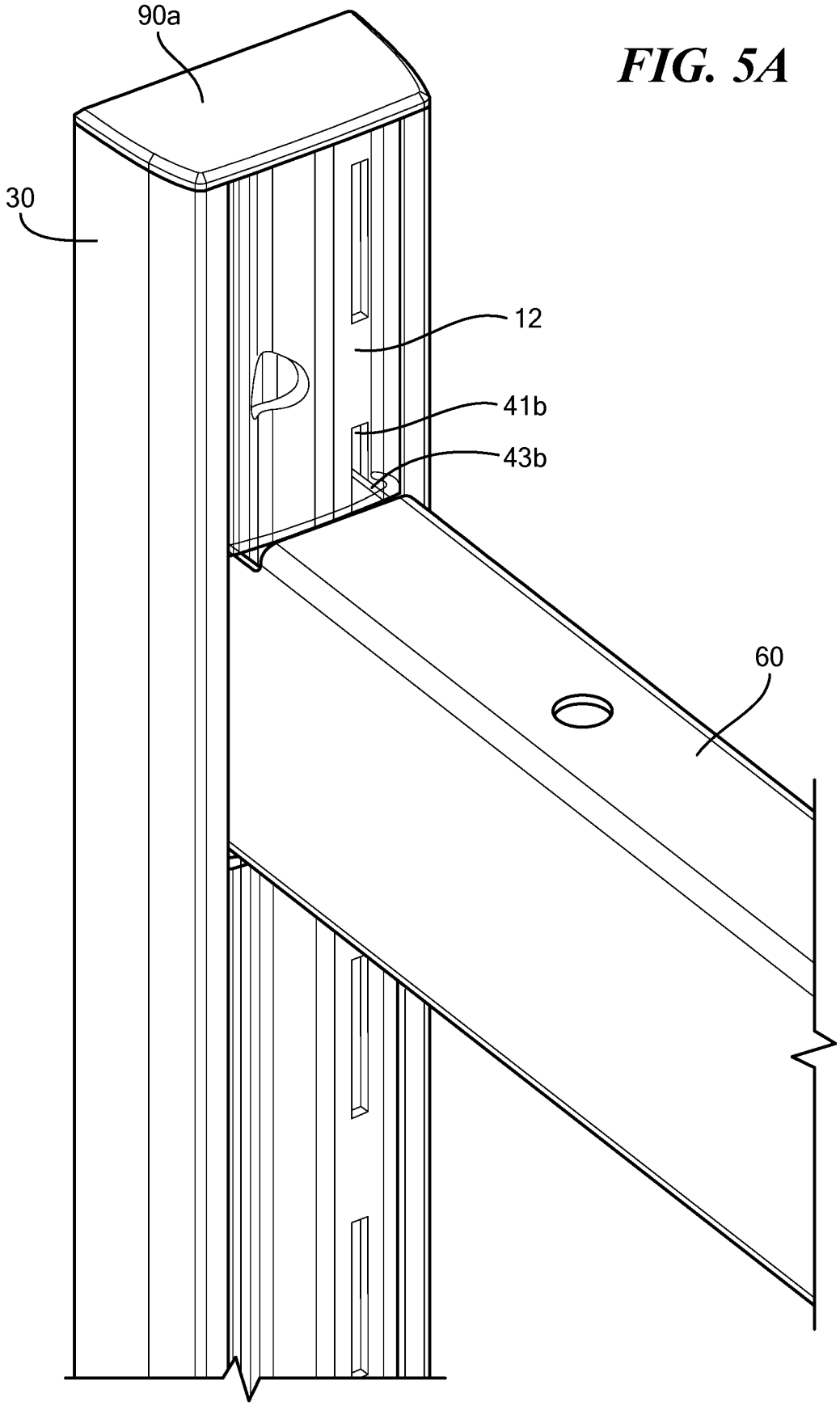
FIG. 5 shows a portion of the shelf system without the front covers (FIG. 5A) and with the front covers (FIG. 5B)
Figure 5B:
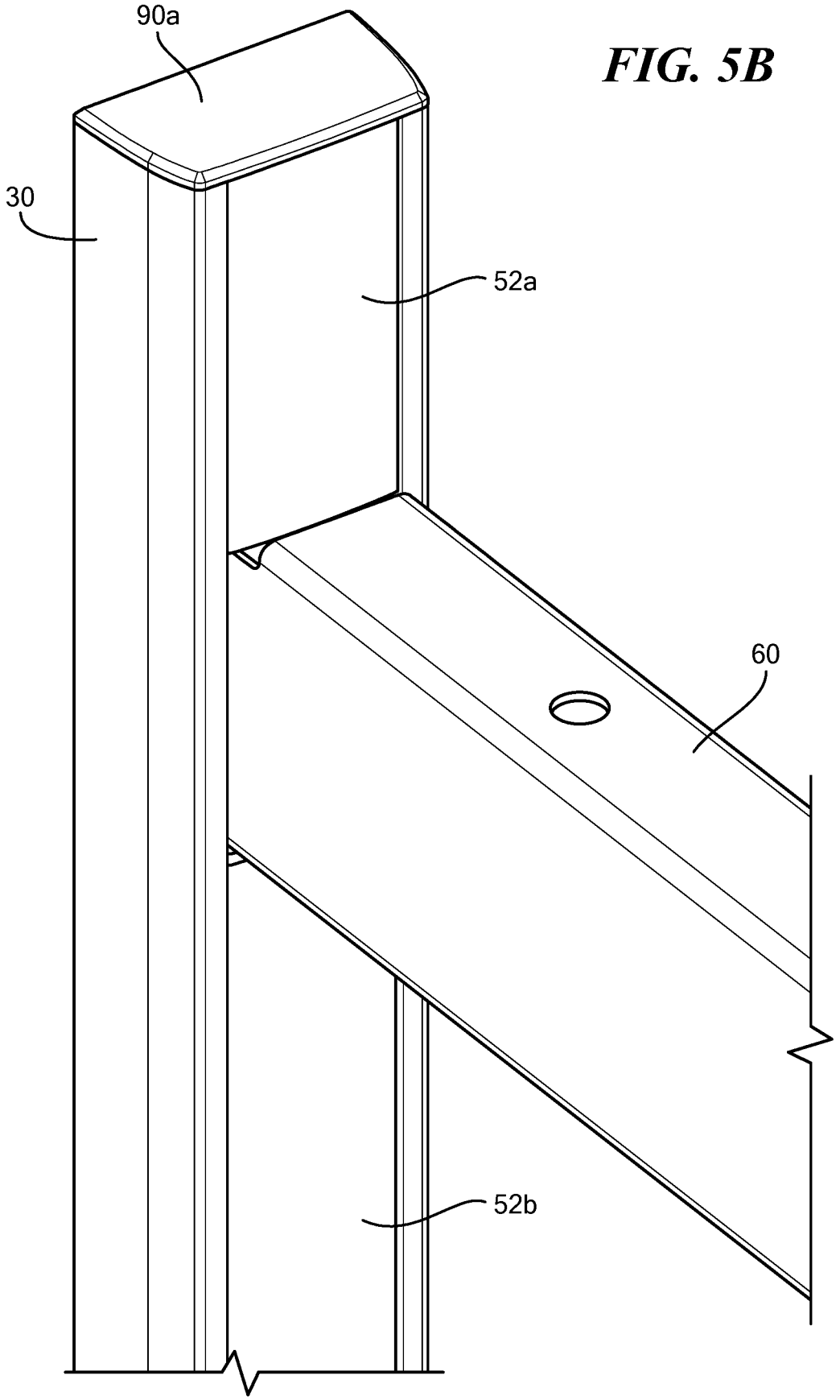

In some embodiments, the width of the bracket 16, at least at the rear thereof, is coextensive with or nearly coextensive with the width of the shroud channel as shown in FIG. 5A to cover the vertical support member 12 in the area where the bracket is mounted.

Additional cover members or plugs 90*a*, 90*b*, and 90*c* can be placed on the ends of shroud 30 (see members 90*a*, 90*b*) and the ends of the brackets (see member 90*c*).

The result, in the preferred embodiment, is a new adjustable shelf covering system which is easy to install, which is inexpensive, and which is assembled quickly. Typically, the shroud and the cover member are made of aluminum or plastic materials and may be painted or include a wood grain type finish, or the like.

Figure 3:
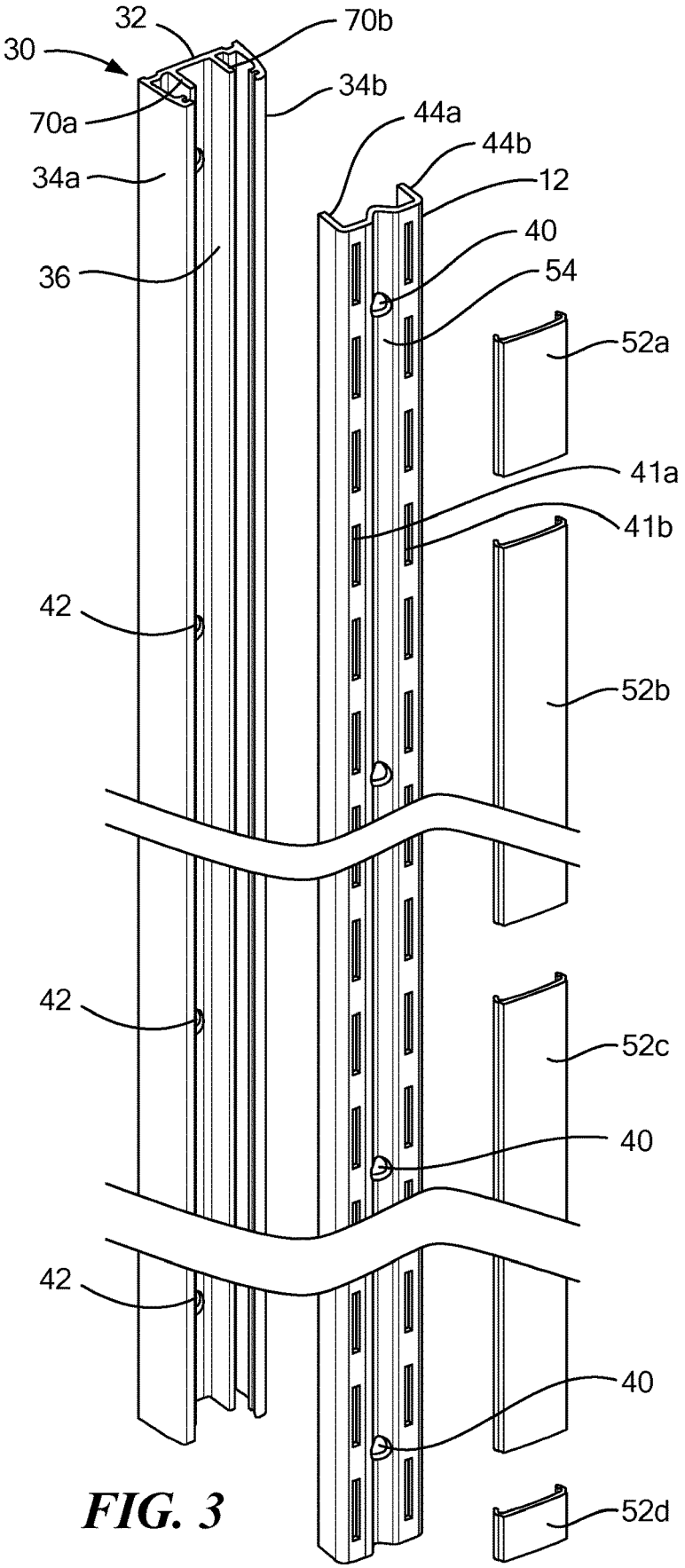
FIG. 3 is a schematic front exploded view showing a shroud, a vertical support member, and covering components for the vertical support member.
Figure 4A:
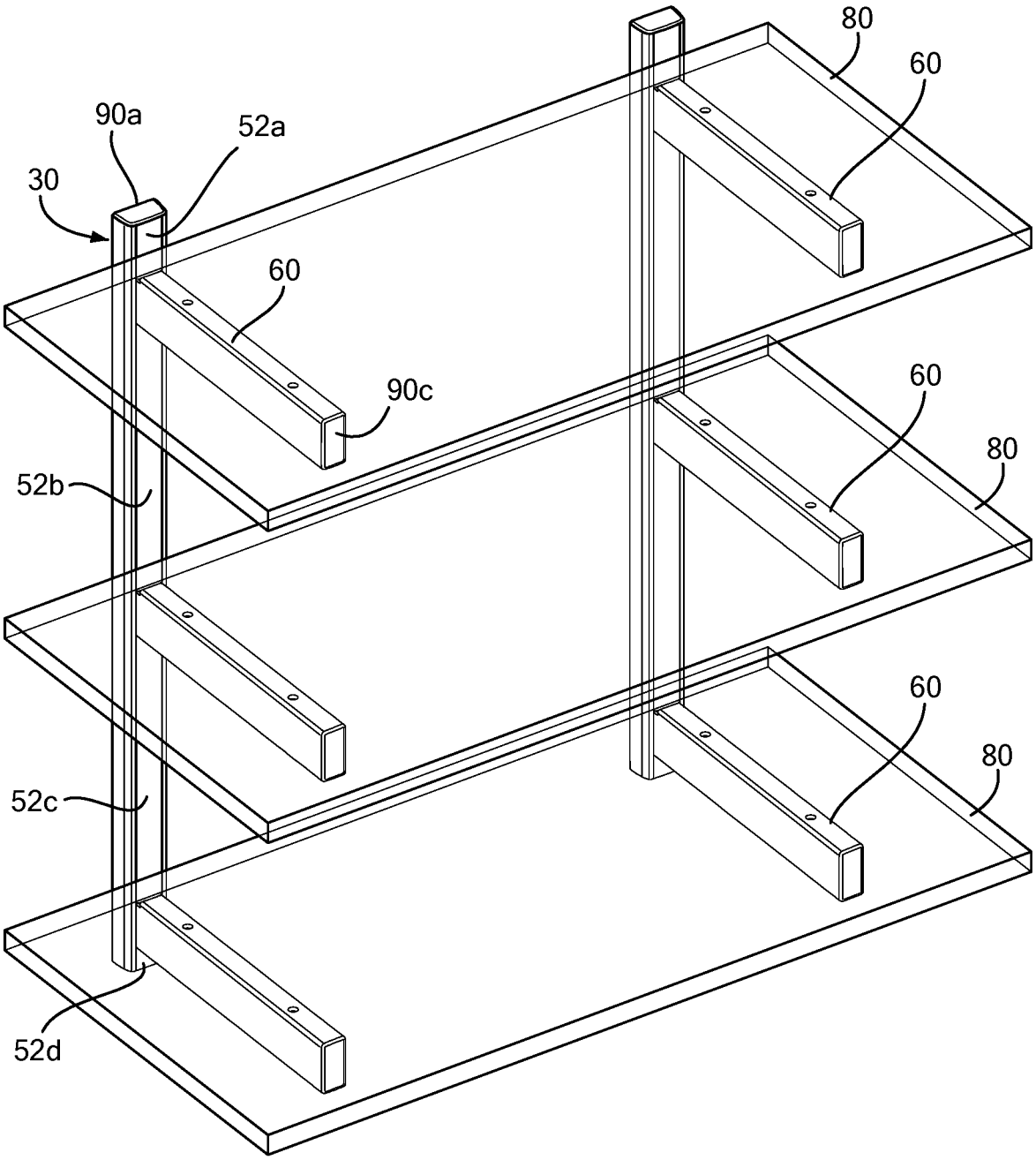
FIGS. 4A-4B are schematic views showing an assembled supportive and aesthetically pleasing adjustable shelf system.
Figure 4B:
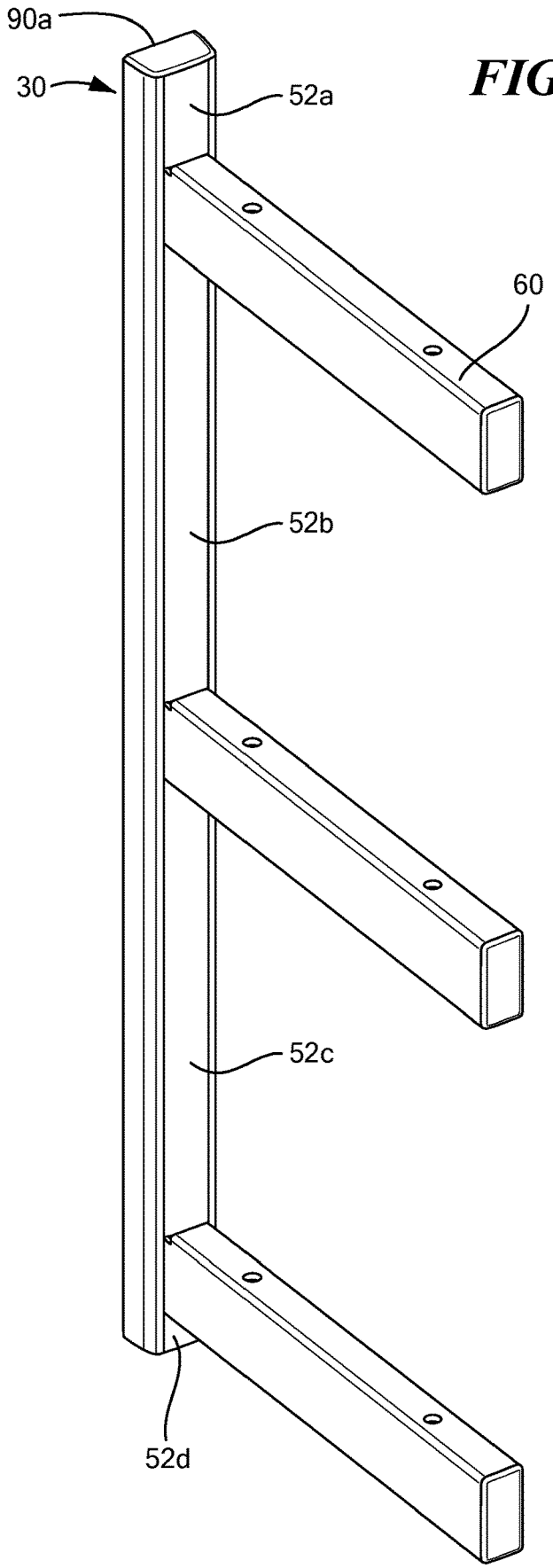
Figure 7:
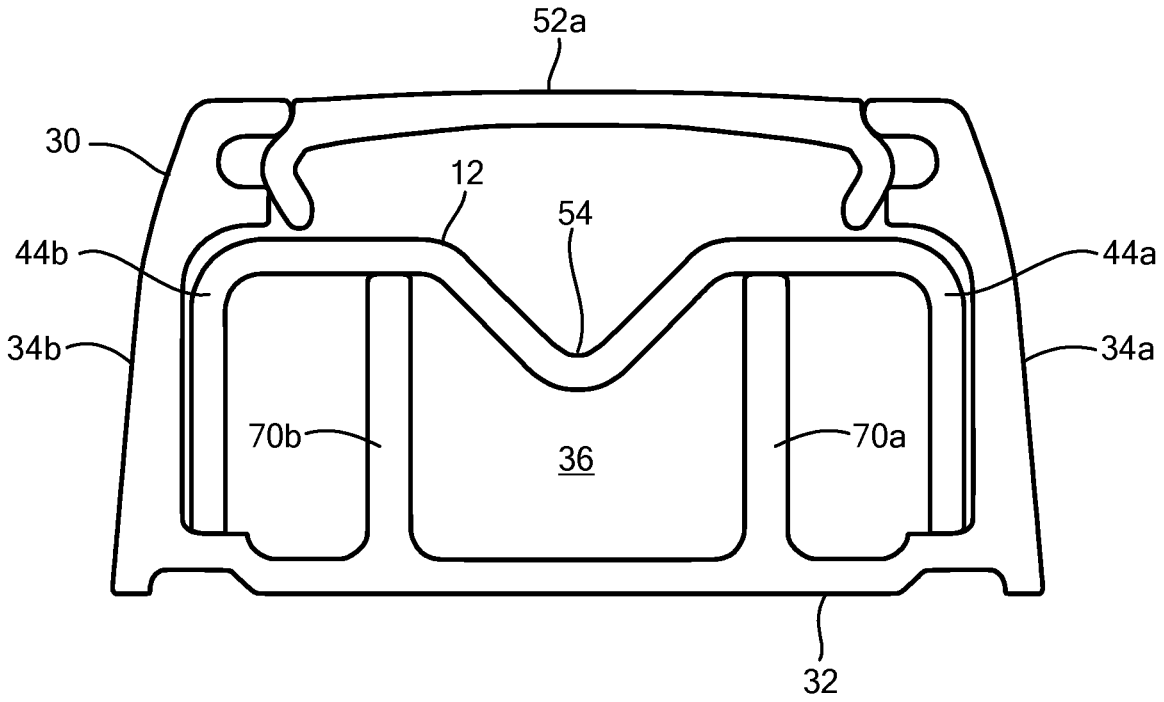
FIG. 7 shows additional details of a shroud, vertical support member, and a cover.

FIG. 3 also shows shroud 30, vertical support member 12, and front cover members 52*a*, 52*b*, 52*c*, and 52*d*. See also FIGS. 4A-4B, 5A-5B and 6-7. FIG. 7 shows how cover member 52*a* snap fits into the shroud 30 between side walls 34*a*, 34*b* and how vertical support member 12 spans nearly the full extent of shroud 12 channel 36 between sidewalls 34*a*, 34*b*.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant cannot be expected to describe certain insubstantial substitutes for any claim element amended.

Other embodiments will occur to those skilled in the art and are within the following claims.

What is claimed is:

1. An adjustable shelf system comprising:

a C-shaped vertical support member with slots in a front face thereof and sidewalls;

brackets each having at least one rearward hook engageable into a corresponding slot from said slots;

a C-shaped shroud configured to be located behind the vertical support member and including sidewalls for covering the sidewalls of the C-shaped vertical support member, a rear wall with ribs for configured to abut and support the vertical support member, and a channel configured to receive the vertical support member between the side walls of the shroud; and a cover member separable into strips configured for placement over the front face of the vertical support member and mateable into and within the shroud above and below the brackets.

2. The adjustable shelf system of claim 1 in which the cover member is cuttable into said strips.

3. The adjustable shelf system of claim 1 in which the C-shaped vertical support member spans a length of the C-shaped shroud channel.

4. The adjustable shelf system of claim 1 in which the bracket has a width proximate a width of the C-shaped shroud channel.

5. The adjustable shelf system of claim 1 in which the strips of the cover member snap fit into the shroud over the channel.

* * * * *